United States Patent [19]

Reinhorn et al.

[11] Patent Number: 4,586,361

[45] Date of Patent: May 6, 1986

[54] PRESS BRAKE DEFLECTION COMPENSATION STRUCTURE

[75] Inventors: Andrei Reinhorn, Williamsville; George H. Trautman, Jr., Buffalo, both of N.Y.

[73] Assignee: Niagara Machine & Tool Works, Buffalo, N.Y.

[21] Appl. No.: 643,789

[22] Filed: Aug. 24, 1984

[51] Int. Cl.[4] ..... B21D 31/00

[52] U.S. Cl. ..... 72/389; 72/448

[58] Field of Search ..... 72/389, 386, 448, 465, 72/446, 380, 447, 462

[56] References Cited

U.S. PATENT DOCUMENTS

| | | | |
|---|---|---|---|
| 2,199,864 | 3/1939 | Wehr | 153/21 |
| 2,456,856 | 12/1948 | Bath | 153/21 |
| 3,584,497 | 6/1971 | Pohjola | 72/448 |
| 3,587,286 | 6/1971 | Fritsch | 72/389 |
| 3,889,515 | 6/1975 | Grombka | 72/448 |
| 3,965,721 | 6/1976 | Roch | 72/462 |
| 4,016,742 | 4/1977 | Shiokawa | 72/465 |
| 4,063,445 | 12/1977 | Haenni et al. | 72/465 |
| 4,098,109 | 7/1978 | Cailloux | 72/389 |
| 4,106,323 | 8/1978 | Haenni et al. | 72/389 |
| 4,137,748 | 2/1979 | Grombka | 72/448 |
| 4,347,727 | 9/1982 | Galiger | 72/389 |
| 4,354,374 | 10/1982 | Deguchi | 72/389 |
| 4,426,873 | 1/1984 | Pearson et al. | 72/389 |

FOREIGN PATENT DOCUMENTS 2914744 10/1980 Fed. Rep. of Germany ..... 72/477

*Primary Examiner*—Francis S. Husar
*Assistant Examiner*—David B. Jones
*Attorney, Agent, or Firm*—Joseph P. Gastel

[57] ABSTRACT

A deflection compensation structure for a press brake having a frame, a bed on the frame, a ram on the frame, and an elongated die on the bed, the press brake deflection compensation structure including a housing for attachment to the bed of the press brake, the housing including an elongated bottom plate, a lower elongated wedge member mounted on the elongated plate, an upper elongated wedge member mounted on the lower wedge member, the upper and lower wedge members having mating inclined surfaces, the lower wedge member having a wide edge and a narrow edge, an elongated slot running lengthwise of the wide edge, a plurality of spaced slots extending inwardly from the wide edge and intersecting the elongated slot, an elongated rod in the elongated slot, a first rigid attachment between the elongated rod at one end of the lower wedge member, and a second movable attachment connected to the other end of the elongated rod for effectively lengthening and shortening the elongated rod to thereby cause the lower wedge member to be urged into different convex shapes at its narrow edge and thus cause the central portion of the upper wedge member to be raised varying amounts at the central portion thereof to compensate for deflection of the press bed and ram.

17 Claims, 11 Drawing Figures

PRESS BRAKE DEFLECTION COMPENSATION STRUCTURE

BACKGROUND OF THE INVENTION

The present invention relates to an improved deflection compensation structure for mounting on the bed of a press brake.

By way of background, the beds and rams of press brakes inherently deflect during pressing operations. To remedy this, numerous types of deflection compensation structures have been proposed in the past. Among these types were structures which incorporated flexible wedges for effectively compensating for the deflection of the press brake bed and ram. However, the flexible wedge structures were either unduly complicated or were constructed in such a manner that they were difficult to install and/or use.

SUMMARY OF THE INVENTION

It is an object of the present invention to provide an improved defection compensation structure for a press brake which is relatively simple in construction.

Another object of the present invention is to provide an improved deflection compensation structure for a press brake which can be mounted in different types of press brakes in an extremely simple and expedient manner and which can be operated simply. Other objects and attendant advantages of the present invention will readily be perceived hereafter.

The present invention relates to deflection compensation structure to compensate for deflection of the bed and ram of a press brake comprising a housing, an upper elongated wedge member in said housing having a lower inclined surface and end portions and a central portion therebetween, a lower elongated wedge member in said housing having a longitudinal axis and a wide edge and a narrow edge and end portions and a central portion between said end portions, an upper inclined surface on said lower wedge member in engagment with said lower inclined surface of said upper wedge member, securing means for securing said end portions of said lower elongated wedge member against substantial movement relative to said housing in a direction transverse to said longitudinal axis, a plurality of transverse slots spaced longitudinally of said longitudinal axis between said end portions of said lower wedge member and extending inwardly into said lower wedge member from said wide edge, and force-applying means for applying forces to said lower wedge member at said end portions proximate said wide edge to thereby cause said narrow edge of said lower wedge member to bow into a convex configuration and thus cause said upper inclined surface at said central portion of said lower wedge member to move in a direction toward said narrow edge a greater distance than said end portions of said lower wedge member to thereby effectively raise said upper wedge member at the central portion thereof to compensate for deflection of said bed and ram adjacent said central portions of said wedge members.

The present invention also relates to a wedge construction for deflection compensation structure comprising an elongated wedge member having a longitudinal axis and a narrow edge and a wide edge, an inclined side extending between said narrow edge and said wide edge, a side opposite to said inclined side extending between said narrow edge and said wide edge, a plurality of spaced slots extending inwardly into said wedge member from said wide edge and extending between said inclined side and said opposite side, and an elongated slot oriented substantially parallel to said longitudinal axis and extending inwardly into said wedge member from said wide edge.

The various aspects of the present invention will be more fully understood when the following portions of the specification are read in conjunction with the accompanying drawings wherein:

DESCRIPTION OF THE PREFERRED EMBODIMENTS

Figure 1:
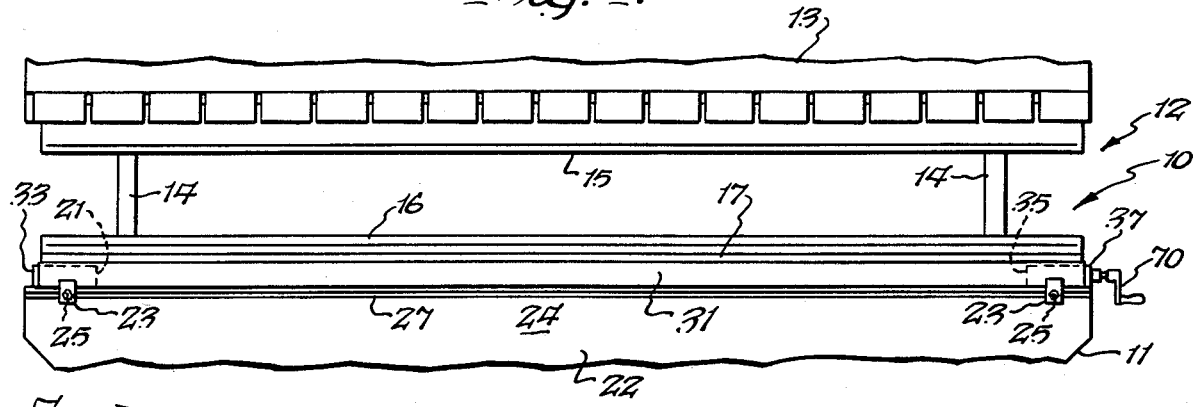
FIG. 1 is a fragmentary side elevational view of a press brake mounting the improved deflection compensation structure of the present invention.

The improved deflection compensation structure 10 is shown in FIG. 1 mounted on the bed 11 of press brake 12 having a ram 13 movable on frame portions 14 toward and away from bed 11 in the conventional manner. As is well known, ram 13 carries a die member 15 which cooperates with die member 16 on bed 11 to bend a workpiece therebetween.

Figure 2:
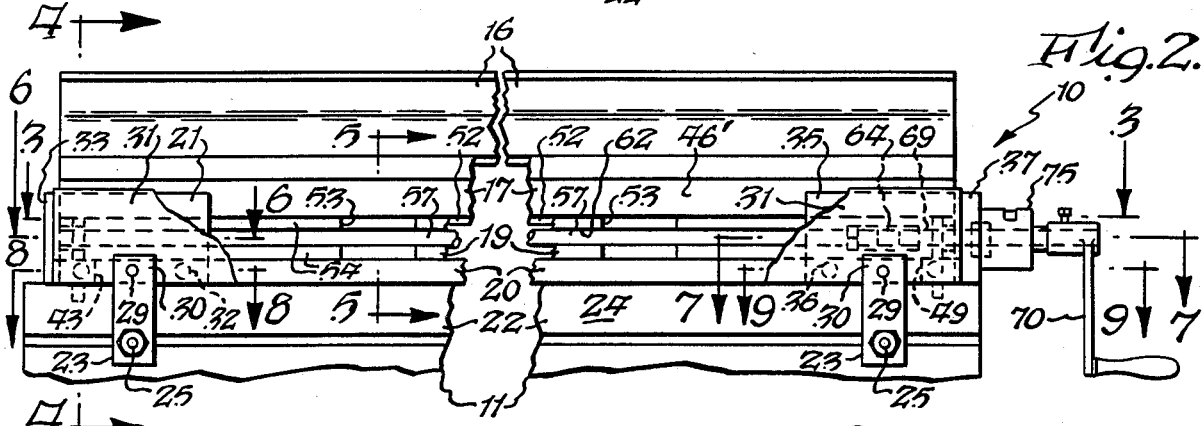
FIG. 2 is a fragmentary enlarged side elevational view of the bed portion of the press brake of FIG. 1 mounting the improved deflection compensation structure.
Figure 3:
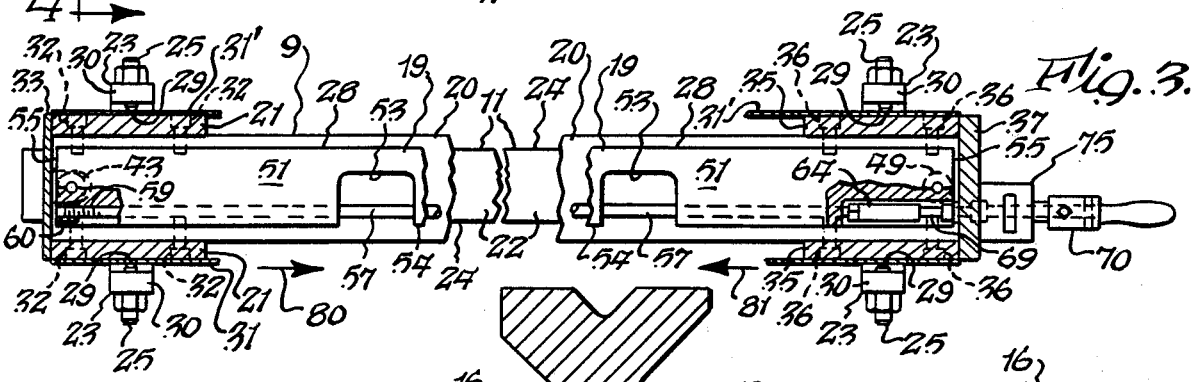
FIG. 3 is a fragmentary cross sectional view taken substantially along line 3—3 of FIG. 2.
Figure 4:
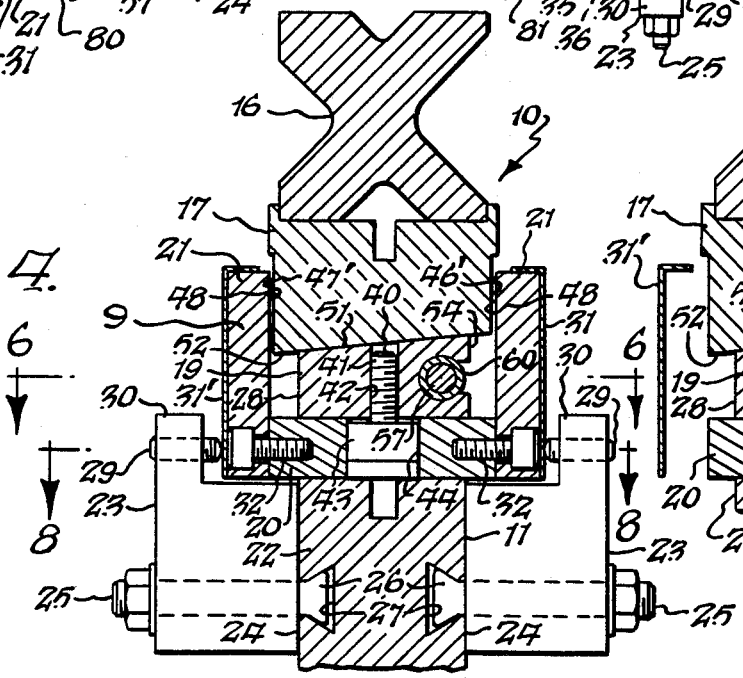
FIG. 4 is a fragmentary enlarged cross sectional view taken substantially along line 4—4 of FIG. 2 and showing the interrelationship between the various parts of the deflection compensation structure and also showing the structure for mounting the deflection compensation structure of the bed of the press brake.
Figure 5:
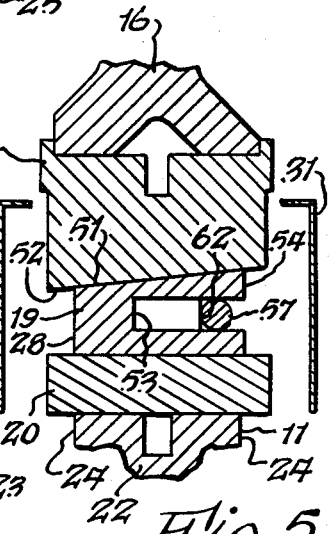
FIG. 5 is an enlarged fragmentary cross sectional view taken substantially along line 5—5 of FIG. 2.
Figure 1A:
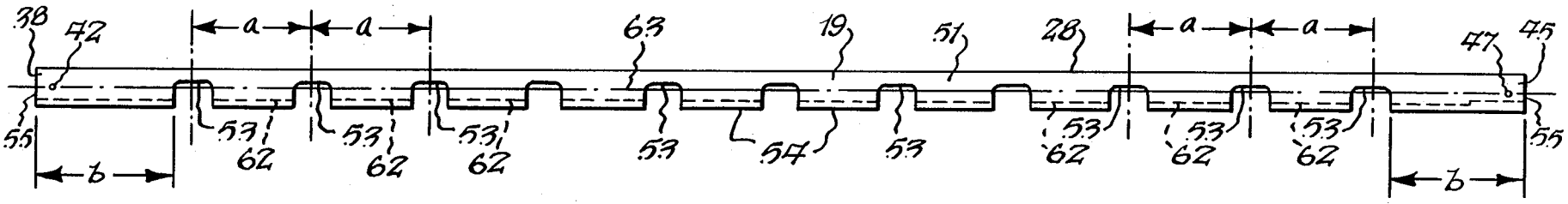
FIG. 1A is a plan view of the elongated wedge member which forms a part of the deflection compensation structure.

Broadly, the deflection compensation structure 10 (FIG. 4) includes an upper wedge member 17, a lower wedge member 19 of special configuration, a lower elongated plate 20, blocks 21 and 35 (FIGS. 2 and 3) secured to plate 20, and associated structure to be described in greater detail hereafter. The plate 20 and blocks 21 and 35 comprise a housing 9 in which wedge members 17 and 19 are mounted.

Figure 6:
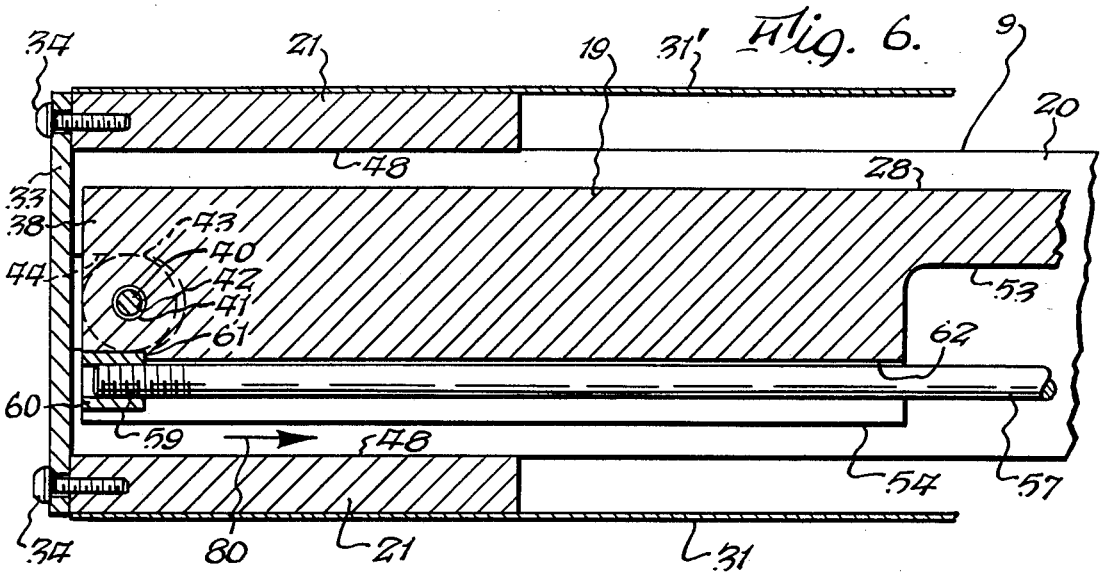
FIG. 6 is an enlarged cross sectional view taken substantially along line 6—6 of FIGS. 2 and 4 and showing various details of the left end of the deflection compensation structure.
Figure 7:
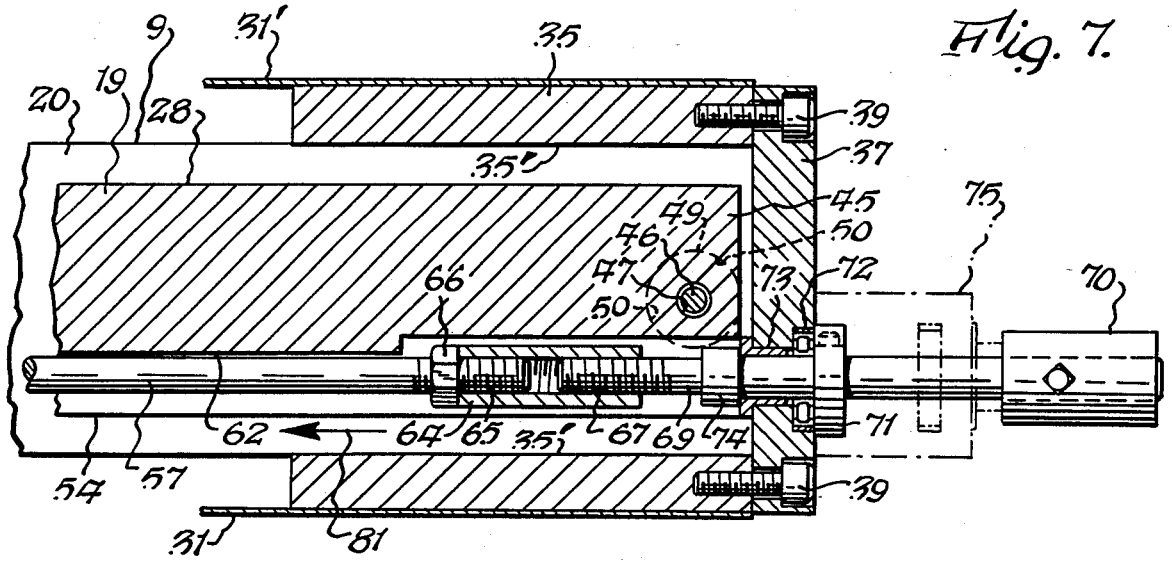
FIG. 7 is a fragmentary cross sectional view taken substantially along line 7—7 of FIG. 2 and along line 6—6 of FIG. 4 and showing the various details of the right end of the deflection compensation structure.
Figure 9:
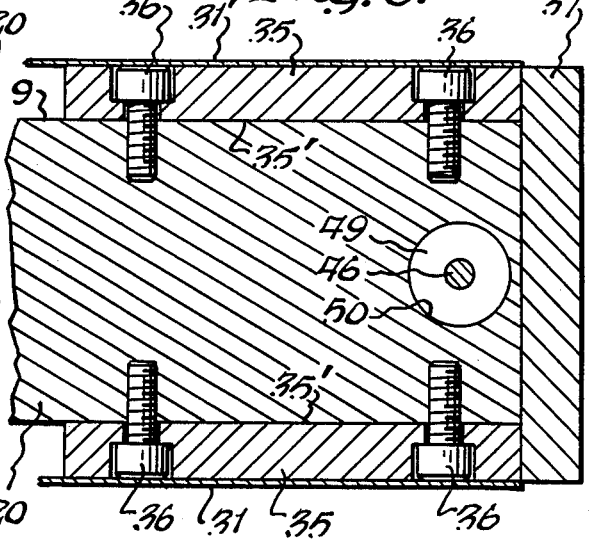
FIG. 9 is a fragmentary cross sectional view, taken substantially along line 9—9 of FIG. 2 and showing the structure for mounting the right end of the deflection compensation structure on the bed of the press brake.

The left end of the housing 9 of the deflection compensation structure 10 is secured to portion 22 of bed 11 by two blocks 23 (FIGS. 2, 3 and 4) which bear against sides 24 of bed 11 and are secured thereto by bolts 25 having heads 26 which are received in mating relationship in dovetail slots 27 of bed portion 22. Set screws 29 extend through upper portions 30 of blocks 23 and effectively bear against the sides 31 of blocks 21 which are rigidly secured to elongated plate 20 by means of screws 32. Blocks 21 at the left end 38 of the deflection compensation structure have surfaces 48 (FIG. 4) which are contiguous to surfaces 46' and 47' of upper wedge member 17 and thus prevent lateral movement thereof. An end plate 33 is secured to blocks 21 by means of screws 34 (FIG. 6). The right end of the housing 9 is secured to bed portion 22 in an analogous manner to that described above relative to the left end by two blocks 23 which have set screws 29 (FIGS. 2 and 3) which bear against blocks 35 (FIGS. 2, 3 and 9) which are secured to elongated plate 20 by means of screws 36. Blocks 35 have surfaces 35' (FIG. 9) which are contiguous to surfaces 46' (FIG. 2) and 47' (FIG. 4) of upper wedge member 17 and thus prevent lateral movement thereof. An end plate 37 (FIG. 7) is secured to blocks 35 by means of screws 39. Sheet metal plates 31 and 31' have upper portions which rest on blocks 21 and 35 and they are clamped in position against the blocks by set screws 29.

Figure 8:
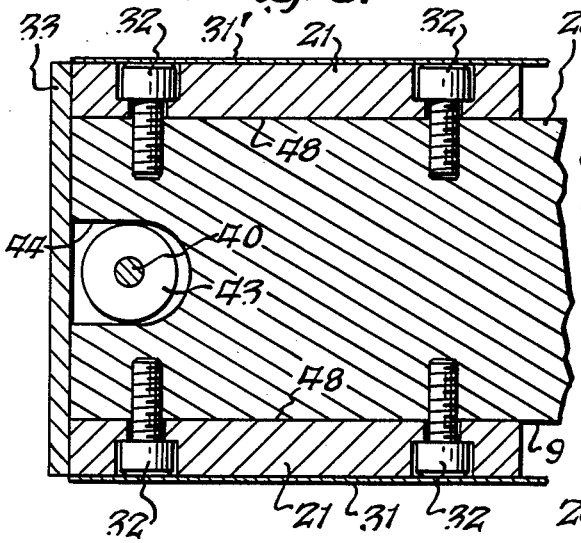
FIG. 8 is a fragmentary enlarged cross sectional view, taken substantially along line 8—8 of FIG. 2 and showing the structure for mounting the left end of the deflection compensation structure on the bed of the press brake.

As noted above, the deflection compensation structure 10 includes a lower wedge member 19 (FIGS. 3, 4, 1A and 6A) and an upper wedge member 17 on which lower die 16 is mounted. Lower wedge member 19 is elongated and extends substantially the entire distance between end plates 33 and 37. The left end of lower wedge member 19 is secured to elongated plate 20 by means of a device known by the trademark CAMROL, which is essentially a pin 40 having a threaded shank 41 which is threadably received in bore 42 in lower wedge member 19 and which has a cylindrical head 43 mounted on bearings relative to shank 41. Cylindrical head 43 is rotatably received in slot 44 (FIGS. 4 and 8) of elongated plate 20. The right end 45 of elongated wedge member 19 is mounted relative to plate 20 in a similar manner. In this respect, the shank 46 (FIG. 9) of a CAMROL is received in a threaded bore 47 in wedge member 19 and the cylindrical rotating head 49 of the CAMROL is received in bore 50 of plate 20. The foregoing mounting construction permits the right end 45 of wedge member 19 to pivot about the axis of shank 46, and the left end 38 of wedge member 19 can both pivot and move axially relative to its underlying plate 20.

Figure 6A:
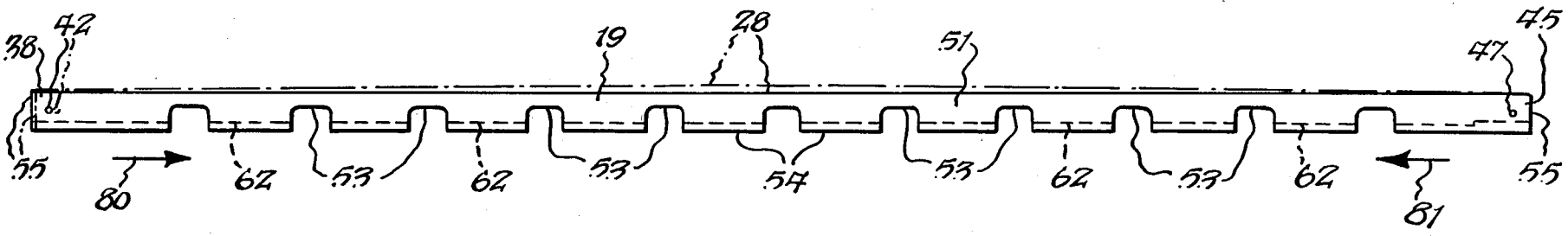
FIG. 6A is a plan view showing the wedge member of the deflection compensation structure in a straight and bowed condition.

Deflection compensation is achieved by causing the lower wedge member 19 to be bowed different amounts between its solid line and its dotted line positions shown in FIG. 6A and thus raise the central portion of upper wedge member 17 varying amounts. This is achieved by the following structure. Elongated wedge member 19 has an upper inclined surface 51 (FIG. 4) which bears against lower inclined surface 52 of upper wedge member 17. As the lower wedge member 19 is bowed to the dotted line condition of FIG. 6A, the undersurface 52 at the central portion of upper wedge member 17 will be raised. Lower wedge member 19 has a plurality of uniformly spaced slots 53 of equal size extending inwardly into wedge member 19 from the wide edge 54 thereof. Slots 53 are spaced apart on centers a. The end slot 53 at each end of the wedge member 19 is spaced from ends 55 a distance b which is greater than distance a. The wedge member 19 is therefore uniformly flexible throughout its length between the outermost slots 53 and is less flexible at the outer end portions between ends 55 and the adjacent slots 53. The combined action of lower wedge member 19 and upper wedge member 17 will match the combined deflection of the bed and ram.

In order to cause wedge member 19 to deflect between the solid and dotted line positions of FIG. 6A, an elongated rod 57 is effe,tively shortened and lengthened. Rod 57 is located in elongated slot 62 which extends inwardly into wedge member 19 from the wide edge 54 thereof and extends substantially throughout the length of wedge member 19 and is substantially parallel to the longitudinal axis 63 (FIG. 1A) thereof. The left end of rod 57 is fixedly secured relative to the left end 38 of wedge member 19 (FIGS. 3, 4 and 6) by means of a threaded connection wherein the threaded end 59 of rod 57 is received in annular bushing 60 which seats against annular shoulder 61. The right end of rod 57 (FIGS. 3 and 7) is received in internally threaded nipple 64 by means of a threaded connection with threads 65 at the end of rod 57. A lock nut 66 adjustably secures nipple 64 on threads 65. A threaded connection also exists between threads 67 of shaft 69 which is fixedly secured to handle 70. To secure shaft 69 against axial movement, a locking collar 71 is rigidly attached to shaft 69 and bears against thrust bearing 72 which is mounted on end wall 37, and an additional locking collar 74 bears against the end of bushing 73 which is interposed between shaft 69 and end plate 37.

It can readily be seen that as handle 70 is rotated, the threaded end 67 of shaft 69 will move internally threaded nipple 64 axially and thus effectively lengthen or shorten rod 57. As rod 57 is shortened, the narrow edge 28 of lower wedge member 19 will become more convex, and as rod 57 is effectively lengthened, the narrow edge 28 will become less convex. As the central portion of narrow edge 28 becomes more convex, the central portion of upper inclined surface 51 of wedge member 19 will move to the left in FIG. 4 while the end portions of wedge member 19 are held against movement transverse to axis 63 by the CAMROL devices, to thus tend to raise the central portion of upper wedge member 17, and compensate for the deflection of the central portions of the bed 11 and ram 15. During the shortening of rod 57, facing forces 80 and 81 (FIGS. 3, 6 and 7) are applied to the end portions 38 and 45 of lower wedge member 19 proximate the wide edge. As can be seen from FIG. 4, upper wedge member 17 is wider than lower wedge member 19, and thus the ends 38 and 45 of lower wedge member 19 may move laterally slight amounts during bowing while the ends of upper wedge member 17 are restricted against movement by blocks 21 and 35.

A counting device 75 may be mounted on end plate 37 for the purpose of measuring the rotations of shaft 69 from a given position and thus in effect provide a measure of the degree of convexity of narrow edge 28. It will also be appreciated that while a handle 70 has been shown to rotate shaft 69, a suitably geared motor may be substituted therefor.

By way of example and not of limitation, in a specific embodiment, lower wedge member 19 was 120 inches long and 3 inches wide. Slots 53 were 3 inches wide and 2 inches deep. Slots 53 were uniformly spaced from each other on 9½ inch centers. Each outer slot 53 was spaced 11 inches from its adjacent respective end of wedge member 19. The upper surface 51 of wedge member 19 was the angle shown in FIG. 4. The narrow edge of lower wedge member 19 is 1 3/16 inches deep and the wide edge is 1½ inches deep. It will be appreciated that the dimensions of slot 53 and other parts may be changed to produce different bowing characteristics to match deflections of different presses.

While preferred embodiments of the present invention have been disclosed, it will be appreciated that the present invention is not limited thereto but may be otherwise embodied within the scope of the following claims.

What is claimed is:

1. Deflection compensation structure to compensate for deflection of the bed and ram of a press brake comprising a housing, an upper elongated wedge member in said housing having a lower inclined surface and end portions and a central portion therebetween, a lower elongated wedge member in said housing having a longitudinal axis and a wide edge and a narrow edge and end portions and a central portion between said end portions, an upper inclined surface on said lower wedge member in engagement with said lower inclined surface of said upper wedge member, securing means for securing said end portions of said lower elongated wedge member against substantial movement relative to said housing in a direction transverse to said longitudinal axis, a plurality of transverse slots spaced longitudinally of said longitudinal axis between said end portions of said lower wedge member and extending inwardly into said lower wedge member from said wide edge, and force-applying means for applying opposed facing forces to said lower wedge member at said end portions proximate said wide edge to thereby cause said narrow edge of said lower wedge member to bow into a convex configuration and thus cause said upper inclined surface at said central portion of said lower wedge member to move in a direction toward said narrow edge a greater distance than said end portions of said lower wedge member to thereby effectively raise said upper wedge member at the central portion thereof to compensate for deflection of said bed and ram adjacent said central portions of said wedge members.

2. Deflection compensation structure as set forth in claim 1 wherein said securing means include means for permitting limited axial movement of at least one of said end portions of said lower wedge member.

3. Deflection compensation structure as set forth in claim 2 wherein said securing means comprise a pin and slot connection effectively positioned between one of said end portions and said housing.

4. Deflection compensation structure as set forth in claim 1 wherein said force-applying means comprise an elongated rod extending substantially parallel to said longitudinal axis, rod end portions on said elongated rod, attachment means for attaching said rod end portions proximate said end portions of said lower wedge member, and means for effectively shortening and lengthening said elongated rod between said attachment means to thereby vary the amount of convexity of said narrow edge.

5. Deflection compensation structure as set forth in claim 4 wherein said housing includes an elongated plate member underlying said lower wedge member and block means secured to said elongated plate member proximate said end portions of said lower wedge member, first sides on said upper wedge member, and second sides on said block members located in contiguous relationship to said first sides of said upper wedge member for restricting lateral movement thereof.

6. Deflection compensation structure as set forth in claim 5 including a clearance between said second sides of said block members and said wide and narrow sides of said lower wedge member at said end portions thereof.

7. A wedge construction for deflection compensation structure comprising an elongated wedge member having a longitudinal axis and a narrow edge and a wide edge and end portions, an inclined side extending between said narrow edge and said wide edge, a side opposite to said inclined side extending between said narrow edge and said wide edge, a plurality of spaced slots extending inwardly into said wedge member from said wide edge in a direction transverse to said longitudinal axis and extending between said inclined side and said opposite side, and an elongated continuous slot extending substantially the entire distance between said end portions and oriented substantially parallel to said longitudinal axis and extending inwardly into said wedge member at said wide edge.

8. A wedge construction for deflection compensation structure as set forth in claim 7 wherein said spaced slots are of substantially the same size.

9. A wedge construction for deflection compensation structure as set forth in claim 7 wherein said spaced slots are spaced equal distances from each other.

10. Deflection compensation structure to compensate for deflection of the bed and ram of a press brake comprising a housing, an upper elongated wedge member in said housing having a lower inclined surface and end portions and a central portion therebetween, a lower elongated wedge member in said housing having a longitudinal axis and a wide edge and a narrow edge and end portions and a central portion between said end portions, an upper inclined surface on said lower wedge member in engagement with said lower inclined surface of said upper wedge member, securing means for securing said end portions of said lower elongated wedge member against substantial movement relative to said housing in a direction transverse to said longitudinal axis, a plurality of transverse slots spaced longitudinally of said longitudinal axis between said end portions of said lower wedge member and extending inwardly into said lower wedge member from said wide edge, force-applying means for applying forces to said lower wedge member at said end portions proximate said wide edge to thereby cause said narrow edge of said lower wedge member to bow into a convex configuration and thus cause said upper inclined surface at said central portion of said lower wedge member to move in a direction toward said narrow edge a greater distance than said end portions of said lower wedge member to thereby effectively raise said upper wedge member at the central portion thereof to compensate for deflection of said bed and ram adjacent said central portions of said wedge members, said force-applying means comprising an elongated rod extending substantially parallel to said longitudinal axis, rod end portions on said elongated rod, attachment means for attaching said rod end portions proximate said end portions of said lower wedge member, means for effectively shortening and lengthening said elongated rod between said attachment means to thereby vary the amount of convexity of said narrow edge, an elongated slot extending inwardly into said lower wedge member from said wide edge, said elongated slot extending substantially parallel to said longitudinal axis, and said elongated rod being located in said elongated slot.

11. Deflection compensation structure as set forth in claim 10 wherein said attachment means comprise first means at one of said end portions of said lower wedge member for anchoring said one of said rod end portions relative thereto, and second means at the other of said rod end portions for effectively providing a threaded connection between said other of said rod end portions and the other of said end portions of said lower wedge member.

12. A wedge construction for deflection compensation structure comprising an elongated wedge member having a longitudinal axis and a narrow edge and a wide edge, an inclined side extending between said narrow edge and said wide edge, a side opposite to said inclined side extending between said narrow edge and said wide edge, a plurality of spaced slots extending inwardly into said wedge member from said wide edge and extending between said inclined side and said opposite side, an elongated slot oriented substantially parallel to said longitudinal axis and extending inwardly into said wedge member from said wide edge, an elongated rod in said elongated slot, end portions on said elongated rod, end portions on said wedge member, means for securing said end portions of said elongated rod relative to said end portions of said wedge member, and means for effectively lengthening and shortening said elongated rod to thereby bow said narrow edge into convex shapes.

13. A wedge construction for deflection compensation structure as set forth in claim 12 including a second wedge member having a second inclined side, and means for mounting said second wedge member on said wedge member with said second inclined side in contact with said inclined side.

14. A wedge construction for deflection compensation structure as set forth in claim 13 wherein said second wedge member is wider than said wedge member.

15. A wedge construction for deflection compensation structure as set forth in claim 14 including end portions on said second wedge member, and means for restricting movement of said end portions of said second wedge member in a direction transverse to said longitudinal axis.

16. A wedge construction for deflection compensation structure as set forth in claim 15 including securing means for securing said end portions of said wedge member while permitting limited movement thereof.

17. A wedge construction for deflection compensation structure as set forth in claim 16 including an elongated plate on the opposite side of said wedge member from said second wedge member, and wherein said securing means comprise pivotal connections between said wedge member and said plate.

* * * * *